United States Patent [19]

Lundberg

[11] 3,978,837

[45] Sept. 7, 1976

[54] DEVICE FOR AUTOMATIC SPEED CONTROL OF A DIESEL ENGINE

[75] Inventor: Karl-Erik Lundberg, Solna, Sweden

[73] Assignee: U.S. Philips Corporation, New York, N.Y.

[22] Filed: Dec. 6, 1974

[21] Appl. No.: 530,278

[30] Foreign Application Priority Data

Dec. 14, 1973 Sweden ..... 7316934

[52] U.S. Cl. ..... 123/139 E; 123/102; 123/103 R

[51] Int. Cl.[2] ..... F02D 1/04; F02M 39/00

[58] Field of Search ..... 123/102, 139 E, 103

[56] References Cited

UNITED STATES PATENTS

| | | | |
|---|---|---|---|
| 3,587,540 | 6/1971 | Hofmann | 123/102 |
| 3,630,177 | 12/1971 | Engel | 123/102 |
| 3,682,145 | 8/1972 | Ohtani | 123/139 E |
| 3,796,197 | 3/1974 | Locher | 123/139 E |
| 3,815,564 | 6/1974 | Suda | 123/139 E |

*Primary Examiner*—Charles J. Myhre
*Assistant Examiner*—Ronald B. Cox
*Attorney, Agent, or Firm*—Frank R. Trifari

[57] ABSTRACT

An automatic speed control device for a diesel engine including a closed control circuit for controlling the power fuel supply. Said means comprise a hydraulic adjusting device which is on/off operative dependent on an error signal. The device comprises a working cylinder with a movable working piston to one end of which a hydraulic or pneumatic control pressure medium is supplied directly, and to the other end of which indirectly via a predetermined volume of a hydraulic liquid, which is fed to the working cylinder through a pipe with a control valve. The control valve delimits in its closed position a portion of the hydraulic liquid to the space between the valve and the working piston. Separating means are provided to prevent mixing of hydraulic liquid and control pressure medium for maintaining the incompressibility of the liquid and make possible a distinct step-by-step control of the position of the working piston. A mechanical coupling is provided so as to transform the translational movement of the piston to a rotational movement such that the turning angle increases with an increasing engine load.

9 Claims, 2 Drawing Figures

DEVICE FOR AUTOMATIC SPEED CONTROL OF A DIESEL ENGINE

This invention is related to a device for automatic speed control of a diesel engine formed by a closed control circuit comprising means for generating an error signal by comparing a signal representing a desired number of revolutions, which is supplied from an operating device, and a signal representing an actual number of revolutions which is fed back from the diesel engine, and further comprising an adjusting device which is coupled to a fuel control device of the diesel engine for controlling the fuel supply.

Control circuits of the closed-loop type in question always show a tendency of self-oscillation and belonging instability. Since a diesel engine comprised in such a control circuit may be looked upon as a filter the attenuation of which increases with an increasing load on the engine, the risk of self-oscillation is smaller at a higher load on the engine since developing oscillations will be attenuated rapidly. When the engine load is smaller developing self-oscillations may disable completely the control circuit and lead to serious breakdowns.

It is commonly known that the tendency of self-oscillation increases when the loop amplification is increased. Since the loop amplification also determines the response time of the control circuit it is desirable to maintain the largest possible loop amplification for each control action.

The closed control circuit is usually provided with a so-called "dead-zone", i.e. a zone in which the motor speed may vary without being influenced by the control circuit. By choosing the size of said dead zone properly the self-oscillation risk may be reduced. Therefore, when deciding on a dead zone the requirement of a good control accuracy will have to be weighted against the requirement of circuit stability.

From the above it is evident that very heavy requirements must be put upon each single element of the control circuit and the output quantities from said elements.

The above-mentioned requirements and desires are satisfied in a device according to the invention which is characterized in that the said adjusting device is shaped as a hydraulic/pneumatic adjusting device which is controllable in accordance with the principle on/off dependent on the error signal and comprises a working cylinder having a movable working piston which via a piston rod comprised in a mechanical coupling is connected to said fuel control device, the position of said working piston being adjustable by means of a hydraulic or pneumatic control pressure medium which is supplied to one end of the working piston directly through a pressure medium pipe which is coupled to the working cylinder, and to the other end of the working piston indirectly via a predetermined volume of a hydraulic liquid which is supplied to the working cylinder through a hydraulic liquid pipe comprising at least one control valve, in which said valve in its closed position delimits a portion of said hydraulic liquid to the space between the control valve and the working piston, while separating means are provided so as to prevent intermixing of hydraulic liquid and control pressure medium for maintaining the incompressibility of said hydraulic liquid and make possible a distinct step-by-step movement of the working piston, and in which said mechanical coupling is constructed so that a translational movement of the working piston is transformed to a rotational movement for influencing the fuel control device in a manner such that a turning angle conditioned by a distinct step movement of the working piston increases with an increasing diesel engine load.

In the inventive device the position of the working piston is determined solely by the amount of hydraulic liquid which is present between the working piston and the control valve. The separating means prevent intermixing of the hydraulic liquid and e.g. air as a control pressure medium. Thus air bubbles are prevented from penetrating into the hydraulic liquid which would make it compressible. In this manner an extremely good movement damping of the working piston at each displacement of the same and a stable locking of the said piston in its stationary state is obtained.

The turning angle determines the loop amplification in a manner such that the loop amplification increases with increasing turning angle. The desirable engine load dependent loop amplification is obtained by means of the mechanical coupling.

The working cylinder and the control circuit therefore provide for an oscillation free operation with moving working piston, which allows an increased loop amplification. The mechanical coupling makes possible a further optimalization of the loop amplification by using the higher damping effect at an increased diesel engine load. Such an optimalization of the loop amplification results in a speed control device working at each control action with an optimum rapidity and accuracy in the actual application.

The control of the adjusting device according to the principle on/off in combination with the dead zone brings with it a step-by-step control with intermediary stationary intervals, which is advantageous for the function and power fuel consumption of the diesel engine. The on/off-control of said adjusting device furthermore makes possible a technically simple solution in that the control valve and also two further control valves which are provided in a known manner in separate pressure medium pipes connected to a pressure medium supply so as to provide the pressure of the pressure medium to the one or the other end of the working piston, all may be of a simple two-position type.

When using compressed air as control pressure medium a particularly simple construction is obtained since the pressure medium must not necessarily be brought back to the supply, which means that the two further control valves may be constructed so as to occupy a first position which opens the connection to the pressure medium supply and a second position providing a connection to the surrounding air. As a pressure medium it is also possible to use the lubricating oil of the diesel engine, the pressure of which is always maintained constant.

According to one embodiment of the device of the invention the mechanical coupling device is provided with an arm one end of which is pivotally connected to the piston rod and the other end of which is pivotally connected to a crank device which is rigidly coupled to a shaft which is connected to the fuel control device and which is arranged substantially transverse to said arm, in which said coupling is so provided that at a low diesel engine load the longitudinal axis of the arm makes a substantially right angle to the longitudinal axis of said crank device, and in which said angle is brought to decrease with an increasing diesel engine load.

For a closer understanding of the device according to the invention one embodiment will be described in the following with reference to the drawing.

Figure 1:
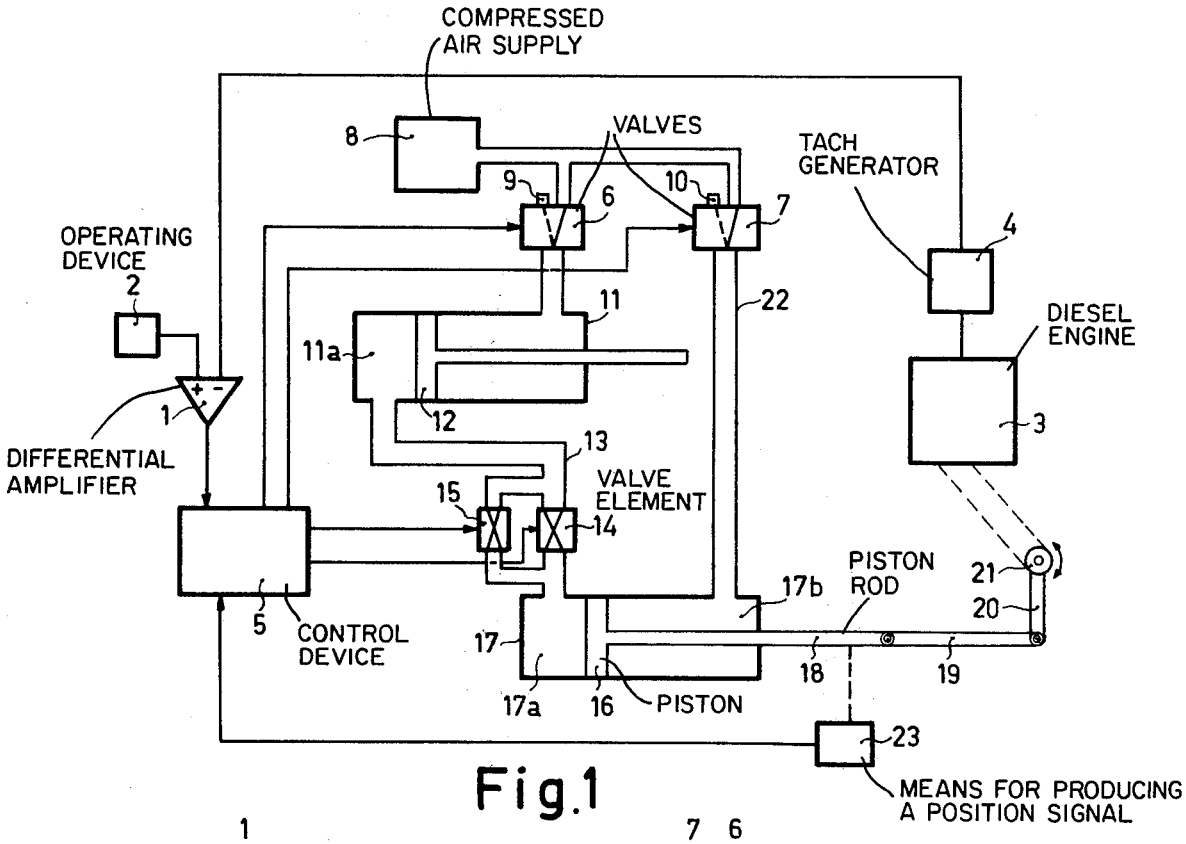
FIG. 1 is a schematic view of a device for automatic speed control of a diesel engine.

Reference numeral 1 in FIG. 1 indicates a differential amplifier 1 for supplying an error signal as the difference between a signal which is supplied from an operating device 2 for setting the speed of the diesel engine 3 and a signal which via a tachometer generator 4 is fed back to the negative input of the differential amplifier 1. The operating device 2 may consist of a potentiometer device supplying a voltage to the differential amplifier 1 which is proportional to the desirable speed.

The output of the differential amplifier 1 is connected to the input of an electronic control device 5 which senses the sign and the amplitude value of an error signal supplied from the differential amplifier.

Each of a pair of valves 6 and 7 can be in a first position, in which compressed air from a compressed air supply 8 is allowed to pass to the system or in a second position, in which compressed air fed back from the system is let out through the openings 9, 10 to the surrounding air.

Both valves 6 and 7 are in the first position when the error signal is zero.

When the error signal is negative the electronic control device 5 comprising a known sign circuit brings valve 6 to its second position while valve 7 remains in its first position.

In the case of a positive error signal electronic control device 5 brings valve 7 to its second position while valve 6 remains in its first position.

Electronic control device 5 also comprising a known threshold circuit actuates a magnetic valve element 14 when the amplitude of the error signal exceeds a predetermined threshold value, while the electronic control device 5 actuates a magnetic valve element 15 when the amplitude of the error signal is below the threshold value.

In order to obtain an optimal functioning of the system it is desirable to control the valves 6, 7 and valve elements 14, 15 in such a way that at the beginning of a control action valve elements 14, 15 are acted upon somewhat later than valves 6, 7 while at the end of the control action valve elements 14, 15 are acted upon a little earlier valves 6, 7. This can easily be realized by adding to the electronic control device 5 a holding circuit known in the art, which holding circuit is interconnected between the sign and threshold circuit outputs and the valves 6, 7 and valve elements 14, 15 respectively.

The adjusting device is provided with an auxiliary cylinder 11 with a movable auxiliary piston 12 therein forming a separating means.

The space 11*a* communicates via a hydraulic liquid pipe 13 (including the magnetic valve elements 14 and 15 arranged in parallel, with a space 17*a* within a working cylinder 17 in which cylinder a piston 16 is movable.

Magnetic valve elements 14 and 15 have a larger and smaller passage respectively so as to make possible a more rapid and more slow positioning respectively of the working piston 16.

Spaces 11*a*, 17*a* and pipe 13 contain a predetermined volume of a hydraulic liquid.

Compressed air supply 8 communicates via a pipe 22 in which valve 7 is incorporated with space 17*b* inside working cylinder 17.

Working piston 16 is provided with a piston rod 18 which is pivotally connected to an arm 19 which on its turn is pivotally connected to a crank device 20.

Crank device 20 is rigidly connected to a shaft 21 which in turn, as is indicated by dashed lines, is coupled to a fuel control device for controlling the supply of fuel to the diesel engine 3.

In the position shown in the drawing, in which the arm 19 makes a substantially right angle to the crank device 20, the load on the diesel engine is low. At a higher engine load the piston rod 18 is in a more protruded position and a movement of the working piston 16 brings with it a proportionally greater turning of the shaft 21.

A means 23 provides a feed-back signal to the electronic control device 5 indicating the position of the working piston 16. Said means may consist of e.g. a differential transformer or a potentiometer, which may be arranged so as to provide a zero output signal voltage when piston 16 is in the position corresponding to idling speed of the engine, and to provide an output signal in load condition of the engine above idling speed which signal increases with increasing load.

The automatic speed control device operates as follows:

The desirable number of revolutions is set by means of the operating device 2 and the differential amplifier 1 senses the difference between the output signal of the operating device 2 and the signal fed back from the diesel engine 3 via the tachometer generator 4, and generates dependent thereon an error signal which is supplied to the electronic control device 5. The sign of the error signal is sensed by the electronic control device 5 and dependent thereon the magnetic valve 6 or 7 is acted upon, and simultaneously the amplitude value of the error signal is sensed, and dependent thereon one of the magnetic valve elements 14, 15 is opened.

Assuming that the error signal is positive, which means that the actual number of revolutions is less than desirable the valve 7 is brought to its second position, i.e. the space 17*b* in the working cylinder 17 is brought into communication with the ambient air through the opening 10 in the valve 7. Dependent on the amplitude value of the error signal immediately thereafter one of the valve elements 14 and 15 is brought to its open position. Thereby the auxiliary piston 12 in the auxiliary cylinder 11 is displaced by the compressed air which is supplied from the compressed air supply 8 via the control valve 6, and an accompanying displacement of the working piston 16 to the right under the influence of the hydraulic liquid occurs. Via the piston rod 18 and the arm 19 a corresponding turning of the crank device 20 and the shaft 21 is obtained so that the fuel control device is acted upon in a sense such as to increase the power fuel supply. The change of the speed of the diesel engine caused thereby is sensed by the tachometer generator 4 and when the input signals of the differential amplifier 1 assume the same value the open valve element 14 or 15 is closed immediately, and thereafter the control valve 7 is again brought back to its first position by the electric control device 5.

Figure 2:
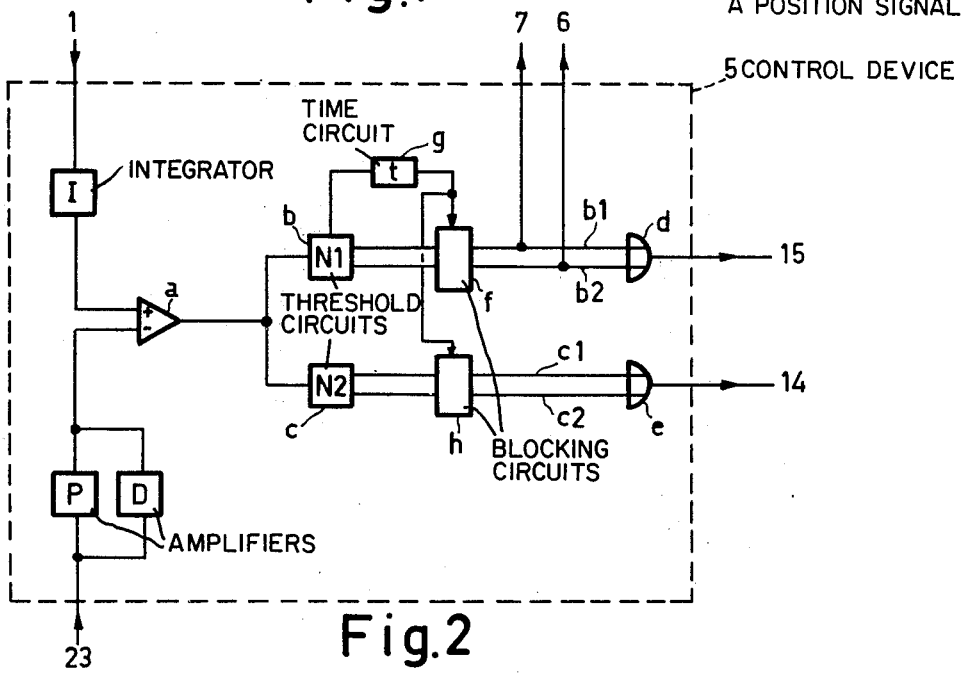
FIG. 2 shows an embodiment of the electronic control device forming part of the speed control device of FIG. 1.

FIG. 2 shows a preferred embodiment of the electronic control device indicated in FIG. 1 with reference numeral 5.

The error signal from differential amplifier 1 is supplied via an integrator I to the (+) input of an operational amplifier *a*, to the (−) input of which is supplied the feed-back piston position signal from the means 23 via a proportional amplifier P and a differentiating amplifier D arranged in parallel.

The output of the operational amplifier a is connected to the inputs of two threshold circuits *b* and *c*, respectively. The two outputs of threshold circuit b are connected to the two inputs of a first OR-circuit *d* via a blocking circuit *f* which is interconnected into the two corresponding output lines *b*1, *b*2. The threshold circuit *b* is further provided with a control output which is connected to a control input of a time circuit *g*, a control output of which is in turn connected to a control input of the blocking circuit *f* and also a control input of a further blocking circuit *h*, which is interconnected into the two output lines *c*1, *c*2 between threshold circuit *c* and a second OR-circuit *e*. The outputs of OR-circuits *d*, *e* are connected to the control inputs of the valve elements 15 and 14, respectively. The output lines *b*1, *b*2 of the threshold circuit *b*, after the blocking circuit *f*, is connected to the control inputs of the magnetic valves 7 and 6, respectively, so as to provide the sign dependent outputs required.

The amplifiers P and D are of a type well known in the art. The P amplifier is arranged so as to provide an output signal which is proportional to the position of piston 16, while the D amplifier is arranged to supply a signal which is proportional to the rate of change of the position of piston 16.

The reason for using two threshold circuits *b* and *c* is to make possible a more slow and more rapid positioning of piston 16, and to provide the "dead zone" mentioned earlier. Circuit *b* is constructed so as to supply an output signal on line *b*1 when the output signal level of a is above a predetermined level +N1, and a signal on line *b*2 when below a corresponding negative level −N1. Similarly circuit *c* is arranged to supply an output signal on line *c*1 when the input signal is above a second predetermined level +N2, and a signal on line *c*2 when below a corresponding negative level −N2, while /N2/>/N1″. The interval −N1 to +N1 defines said "dead zone" within which neither of the circuits *b* and *c* will supply an output signal, and therefore no one of the valves 6, 7, 14, 15 will be actuated. Threshold circuits of the type *b* and *c* are well known in the art. The reason for providing the means 23, the P and D amplifiers, the time circuit *g* and the blocking circuits *f* and *h*, is to compensate for delay time of the magnetic valves and thereby to make possible a shorter response time of the control system and a more accurate control, by making narrower said "dead zone". The time circuit g may consist of a monostable flip-flop which is triggered when the output signal of amplifier a passes into the interval −N1 to +N1. The blocking circuits may be built up from ordinary gate functions.

The integrator I is included to make possible an elimination of the so-called "steady-state error".

Thus the error signal voltage supplied by amplifier 1 will be integrated in integrator I until the error signal reaches the dead zone. The integrated signal is representative of the actual torque developed by the engine.

In amplifier a said integrated signal is combined with a piston position signal from the means 23, which is likewise proportional to the torque developed.

By means of the electronic control device 5 it is possible in a very easy manner to have two or more diesel engines run in parallel. By providing the block 5 with an impedance input for a current type error signal from amplifier 1, it is possible to obtain an equal load distribution between the engines, simply by connecting in parallel the blocks 5 in question to the output of amplifier 1. This cannot be realized with the ordinarily used centrifugal governors.

What is claimed is:

1. A device for control of fuel flow for automatic speed control of an associated diesel engine having an associated fuel control device for controlling the fuel to the diesel engine which comprises:

a working cylinder and a working piston, said working piston being movable responsive to fluid pressure on each side thereof;

means coupling said working piston to the associated fuel control device to vary the quantity of fuel delivered to the associated diesel engine as a function of the working piston position;

a first fluid conduit in fluid communication with said working cylinder and one side of said working piston;

a second fluid conduit in fluid communication with said working cylinder and the other side of said working piston;

a first valve element disposed in series with said second fluid conduit;

means for balancing two fluid pressures between first and second parts thereof without mixing the two fluids under pressure, one part of said means for balancing being in fluid communication with said second fluidconduit; fluid conduit;

a first valve in fluid communication with said second part of said means for balancing which selectively connects said second part of said means for balancing to ambient or an associated source of fluid pressure;

a second valve in fluid communication with said first fluid conduit which selectively connects said first fluid conduit to ambient or the associated source of fluid pressure;

means for producing a first signal which is a function of the speed of the associated diesel engine;

means for producing a second signal which is a function of a predetermined engine speed;

means for comparing said first signal and said second signal; and means for controlling said first valve element, said first valve and said second valve responsive to said means for comparing.

2. The apparatus as described in claim 1, wherein said means for balancing is a cylinder and piston assembly and said first part is the axial section of said cylinder on one side of said piston and said second part is the axial section of said cylinder on the other side of said piston.

3. The apparatus as described in claim 1, wherein said second conduit is bifurcated in at least one axial section thereof, said first valve element being disposed in one of the bifurcations, said device further including a second valve element in the other of the bifurcations.

4. The apparatus as described in claim 3, wherein said second fluid conduit has a liquid therein.

5. The apparatus as described in claim 4, wherein said first conduit has a gas therein.

6. The apparatus as described in claim 5, wherein said gas is air.

7. The apparatus as described in claim 1 further including means for cooperation with said working piston for converting rectilinear motion to rotational motion.

8. The apparatus as described in claim 1 further including means for producing a position signal which is a function of the position of said working piston, and wherein said means for controlling is also responsive to said position signal.

9. The apparatus as described in claim 1 wherein said associate source of fluid pressure is an associated source of air under pressure.

* * * * *

UNITED STATES PATENT AND TRADEMARK OFFICE

CERTIFICATE OF CORRECTION

PATENT NO. : 3978837

DATED : September 7, 1976

INVENTOR(S) : KARL-ERIK LUNDBERG

It is certified that error appears in the above-identified patent and that said Letters Patent are hereby corrected as shown below:

Column 3, line 64, the " , " should be -- ) -- parenthesis

Column 6, line 24, cancel "fluidconduit;"

Signed and Sealed this

Eighteenth Day of January 1977

[SEAL]

*Attest:*

RUTH C. MASON
*Attesting Officer*

C. MARSHALL DANN
*Commissioner of Patents and Trademarks*